United States Patent [19]

Tytgat et al.

[11] Patent Number: 4,981,553

[45] Date of Patent: Jan. 1, 1991

[54] COPPER ETCHING BATH AND METHOD OF USING

[75] Inventors: Daniel Tytgat, Brussels; Stefaan Magnus, Halle, both of Belgium

[73] Assignee: Solvay & Cie (Société Anonyme), Brussels, Belgium

[21] Appl. No.: 245,340

[22] Filed: Sep. 16, 1988

[30] Foreign Application Priority Data

Sep. 25, 1987 [FR] France ..... 87 13407

[51] Int. Cl.[5] ..... C23F 1/00

[52] U.S. Cl. ..... 156/666; 252/79.2

[58] Field of Search ..... 156/666; 134/3, 41; 252/79.2, 186.28

[56] References Cited

U.S. PATENT DOCUMENTS

| | | | |
|---|---|---|---|
| 2,834,659 | 5/1958 | Mathre et al. | 156/666 |
| 3,345,217 | 10/1967 | Wollgien et al. | 156/666 |
| 3,779,842 | 12/1973 | Grunwald et al. | 156/666 |
| 4,144,119 | 3/1979 | Dutkewych et al. | 156/666 |
| 4,788,086 | 11/1988 | Matsuda | 148/261 |
| 4,849,124 | 7/1989 | Backus | 156/666 |

FOREIGN PATENT DOCUMENTS

| | | | |
|---|---|---|---|
| 0115450 | 1/1984 | European Pat. Off. . | |
| 2823068 | 12/1978 | Fed. Rep. of Germany | 156/666 |
| 2578261 | 3/1986 | France . | |
| 52-21223 | 2/1977 | Japan | 252/79.2 |
| 52-65725 | 5/1977 | Japan | 252/79.2 |
| 61-124585 | 6/1986 | Japan . | |
| 62-237447 | 10/1987 | Japan . | |
| 1449525 | 9/1976 | United Kingdom . | |

OTHER PUBLICATIONS

Encyclopedia of Chemical Technology, Third Edition, vol. 17, p. 428, (Phosphoric Acid).

Soviet Inventions Illustrated Sec C., Week 8639, Oct. 9th 1986, Class C, No. 86–257473/39, Derwent Publications.

*Primary Examiner*—David L. Lacey

*Assistant Examiner*—John J. Bruckner

*Attorney, Agent, or Firm*—Spencer & Frank

[57] ABSTRACT

Baths for the chemical polishing of copper or copper alloy surfaces, comprising, in aqueous solution, hydrogen peroxide, chloride ions, phosphoric acid and phosphate and hydrogenphosphate ions, in quantities adjusted so as to impart a pH of between 1.25 and 3 to the bath.

7 Claims, 2 Drawing Sheets

COPPER ETCHING BATH AND METHOD OF USING

The present invention relates to the composition of baths for the chemical polishing of copper or copper alloy surfaces.

The chemical polishing of metal surfaces constitutes a well-known technique (Electrolytic and chemical polishing of metals—W. J. Mc G. TEGART—Dunod—1960 p. 122 et seq.); it consists in treating the metal surfaces to be polished with oxidizing baths.

For the chemical polishing of copper and its alloys, aqueous baths of orthophosphoric acid, nitric acid and acetic acid have been used (loc. cit.: pages 135 and 136). These baths necessitate high working temperatures, of the order of 50° to 80° C., and an intense mechanical agitation. Moreover, they attack the metal at a fast rate, limiting the polishing time to less than five minutes. These features of these known baths represent disadvantages: on the one hand, their use is accompanied by toxic gaseous emissions, and on the other hand, their fast rate of action and the need to subject them to a mechanical agitation makes control of the polishing difficult and uncertain. To remedy these disadvantages, aqueous baths comprising hydrogen peroxide and a mixture of nitric, phosphoric and hydrochloric acids have been proposed. These aqueous baths enable lower working temperatures, of the order of 25° to 35° C., to be used, and their rate of attack of the metal is between 2.5 and 5 microns per minute [Electroplating—October 1953—6—pages 360 to 367 (pages 363 and 364)]. The rate of action of these known baths on the metal is nevertheless still excessive for certain applications. It makes them, in particular, unusable for the polishing of the inner face of the walls of large vessels such as boilers, autoclaves or crystallizers. Since the time required for the filling and emptying of such vessels is generally very much greater than the length of the optimum chemical polishing treatment, it becomes, in effect, impossible to obtain a uniform polishing of the wall, some areas of the latter being insufficiently polished and others being deeply corroded. These known baths are, in addition, ineffective for the polishing of surfaces in contact with which the renewal of the bath is difficult, since they give rise to abrupt modifications of the local compositions of the bath.

Baths comprising, in aqueous solution, phosphoric acid, hydrogen peroxide, hydrochloric acid and 2,6-di-tert-butyl-4-(N,N-dimethylaminomethyl)phenol have also been proposed [SU-A-1,211,338 (ORG. PHYS. CHEM. INST.)]. These known baths appear to possess the property of better stability, but they involve working temperatures of at least 50° C., their rate of action is too rapid and they do not enable polishings of uniform quality to be obtained.

The object of the invention is to remedy the abovementioned drawbacks of the known polishing baths, by providing new bath compositions for the chemical polishing of copper and copper alloys, which exhibit a moderate rate of action, do not necessitate an excess working temperature or an intense mechanical agitation, and provide for polishes of quality superior to that of the polishes obtained with the known baths.

The invention accordingly relates to baths for the chemical polishing of copper or copper alloy surfaces, which comprise, in aqueous solution, hydrogen peroxide, chloride ions and a mixture of phosphoric acid, phosphate ions and hydrogenphosphate ions, in respective quantities adjusted so as to impart a pH value of between 1.25 and 3 to the aqueous solution.

In the baths according to the invention, hydrogen peroxide acts as oxidizing agent for the metal to be polished.

The function of the chloride ions is to protect the metal against uncontrolled local corrosion during the polishing treatment. They may be introduced in the form of any water-soluble compounds, such as hydrochloric acid or an alkali metal chloride. Sodium chloride is preferred.

The phosphate and hydrogenphosphate ions are anions of general formula:

$$(H_xPO_4)^{(3-x)-}$$

where x is between 0 and 2.

The baths according to the invention can contain mixtures of these anions. The latter may be introduced in the form of any water-soluble inorganic compounds, such as alkali metal salts.

According to the invention, the respective quantities of phosphoric acid and of phosphate and hydrogenphosphate anions are chosen so as to impart a pH value of between 1.25 and 3 to the aqueous bath solution, this value being that obtained by mathematical calculation from the contents of phosphoric acid and of phosphate and hydrogenphosphate anions in the aqueous solution. This imposed pH value differs from the actual value effectively measured, which depends, in particular, on the content of hydrogen peroxide and of chloride ions in the aqueous solution. Except where otherwise stated, the pH values mentioned hereinafter will be calculated theoretical values as defined above.

Subject to the production of the abovementioned pH value in the aqueous bath solution, the respective contents of hydrogen peroxide, of chloride ions, of phosphoric acid and of phosphate and hydrogenphosphate ions are chosen according to the nature of the metal treated, the working temperature and the time desired for the polishing treatment. Baths which are very suitable in the majority of applications are those in which the hydrogen peroxide content is between 1 and 6 moles per liter of the aqueous solution and the chloride ion content is between $10^{-4}$ and 1 mole per liter. It is appropriate, moreover, to select the respective contents of phosphoric acid and of phosphate and hydrogenphosphate anions so that their sum is between $10^{-4}$ and 1 mole per liter of the aqueous bath solution, the optimum contents being those for which the following conditions additionally apply:

$$0{,}01 \leqq \frac{\sum_{x=0}^{x=2} [(H_x\,PO_4)^{(3-x)-}]}{\sum_{x=0}^{x=3} [(H_x\,PO_4)^{(3-x)-}]} \leqq 1$$

where $[H_x\,PO_4)^{(3-x)-}]$ denotes the concentration, expressed in mole per liter, of the constituent $(H_x\,PO_4)^{(3-x)-}$ in the aqueous bath solution.

The best results are obtained when the respective contents of phosphoric acid, of phosphate ions and of hydrogenphosphate ions are chosen so that the following conditions are complied with simultaneously:

$$0{,}02 \leqq \sum_{x=0}^{x=3} [(H_x PO_4)^{(3-x)-}] \leqq 0{,}80$$

and $$0{,}1 \leqq \frac{\sum_{x=0}^{x=2} [(H_x PO_4)^{(3-x)-}]}{\sum_{x=0}^{x=3} [(H_x PO_4)^{(3-x)-}]} \leqq 0{,}8$$

Preferred baths are those in which the aqueous solution has a pH value of between 1.65 and 2.35, and comprises:

hydrogen peroxide in a quantity of between 3 and 5 moles/l;

chloride ions in a quantity of between $5\times10^{-3}$ and $5\times10^{-2}$ mole/l;

phosphoric acid and phosphate and hydrogenphosphate ions in respective molar quantities in accordance with the following relationships:

$$0{,}05 \leqq \sum_{x=0}^{x=3} [(H_x PO_4)^{(3-x)-}] \leqq 0{,}4$$

and $$0{,}1 \leqq \frac{\sum_{x=0}^{x=2} [(H_x PO_4)^{(3-x)-}]}{\sum_{x=0}^{x=3} [(H_x PO_4)^{(3-x)-}]} \leqq 1$$

The aqueous solution of the baths according to the invention can contain, in customary proportions, additives commonly present in aqueous baths for the chemical polishing of metals, for example surfactant agents, viscosity regulators and hydrogen peroxide stabilizers.

The chemical polishing baths according to the invention make it possible to produce surface polishes of excellent quality, in particular superior to that of the polishes obtained with the polishing baths described in the document SU-A-1,211,338. A great advantage of the polishing baths according to the invention resides in their capacity, after adaptation of the respective concentrations of their constituents, to carry out polishings at a moderate rate of action, capable of being spread over several hours, so as to permit the uniform polishing of large surfaces or of surfaces that are not readily accessible.

The baths according to the invention are suitable for the polishing of all surfaces composed of copper or copper alloys, such as brass and bronze, for example.

The invention accordingly relates also to a process for polishing the surface of a copper or copper alloy article, according to which the surface to be polished is brought into contact with a polishing bath according to the invention.

In the process according to the invention, the polishing bath may be employed at all temperatures and pressures which entail no risk of degrading its constituents. It has, nevertheless, proved advantageous to use the bath at atmospheric pressure, at a temperature above 20° C. and below 80° C., temperatures between 30° and 60° C. being preferred.

The act of bringing the metal surface into contact with the bath may be carried out in any appropriate manner, for example by immersion.

In the process according to the invention, the contact time of the surface to be polished with the bath must be sufficient to produce an effective polishing of the surface; it cannot, however, exceed a critical value beyond which there is the risk of local corrosion appearing on the surface. The optimum contact time depends on many parameters, such as the metal or alloy forming the surface to be polished, the configuration of this surface and its initial roughness (peak-to-valley height), the composition of the bath, the working temperature, the possible turbulence of the bath in contact with the surface and the ratio between the area of the metal surface to be polished and the volume of the bath employed; it must be determined in each particular case by a routine laboratory procedure.

In a preferred embodiment of the process according to the invention, the surface to be polished is maintained in contact with the bath for a time sufficient to achieve an attack of the metal over a depth equal to at least 10 microns, and preferably between 20 and 50 microns. The length of the treatment of the surface with the bath is thus, in most cases, between 1 and 5 hours.

The importance of the invention will become apparent on reading the application examples which are given below, with reference to the attached drawings.

EXAMPLE 1

(according to the invention)

A copper plate 10 $cm^2$ in area was immersed in 500 $cm^3$ of a bath at approximately 40° C., containing, per liter:

3.5 moles of hydrogen peroxide,
0.012 mole of hydrochloric acid,
0.088 mole of phosphoric acid,
0.021 mole of hydrogenphosphate ions $(HPO_4)^{2-}$,
0.013 mole of phosphate ions $(PO_4)^{3-}$.

This bath had a pH value equal to 2.32.

The plate initially had an arithmetical average roughness $R_a$=0.40 micron.

During the treatment, which lasted 3 hours, the average depth of attack of the plate was 30 microns. After 3 hours' treatment, the roughness had fallen to 0.06 micron.

EXAMPLE 2

(for reference)

The experiment Example 1 was repeated under working conditions according to those described in Example 7 of the document SU-A-1,211,388:

Composition of the polishing bath:
9.4 moles of hydrogen peroxide per liter,
0.584 mole of phosphoric acid per liter,
0.047 mole of hydrochloric acid per liter,
0.04 g of 2,6-di-tert-butyl-4-(N,N-dimethylaminomethyl)phenol per liter,
pH 1.05;
Working temperature: 50° C.;

Length of treatment: 15 minutes.

The average depth of attack of the plate was 60 microns; after the polishing treatment, the arithmetical average roughness of the surface was measured: $R_a = 0.080$ micron.

Figure 1:
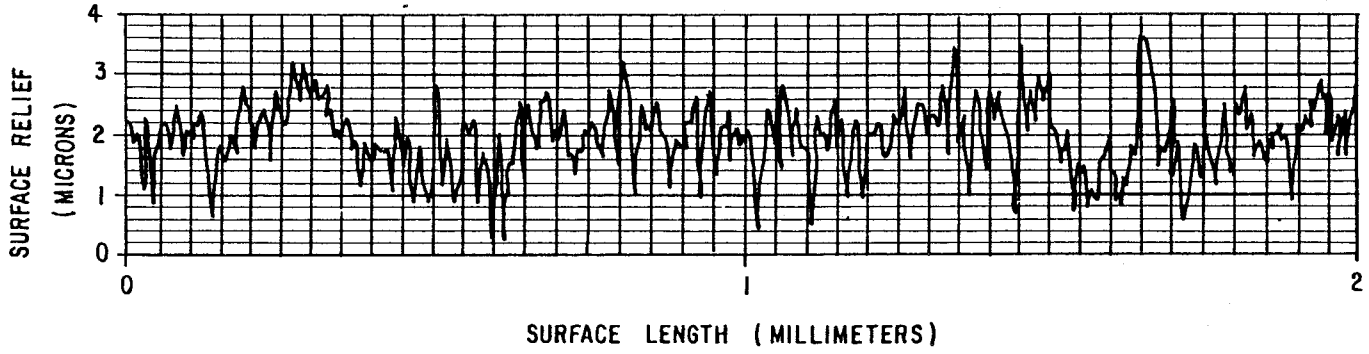
FIG. 1 shows, on a large scale, the profile of a copper surface, before polishing.
Figure 2:
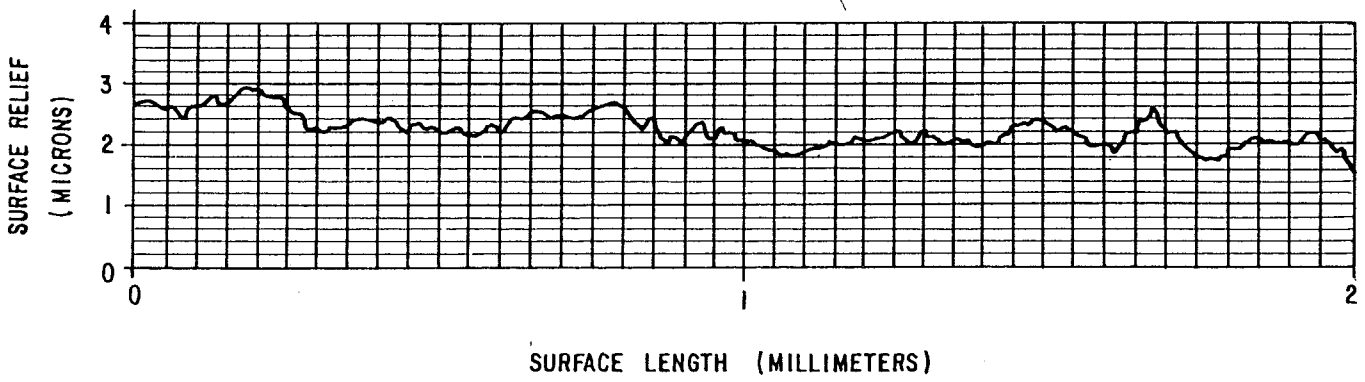
FIG. 2 shows the profile of the same copper surface, after polishing in accordance with the process according to the invention.
Figure 3:
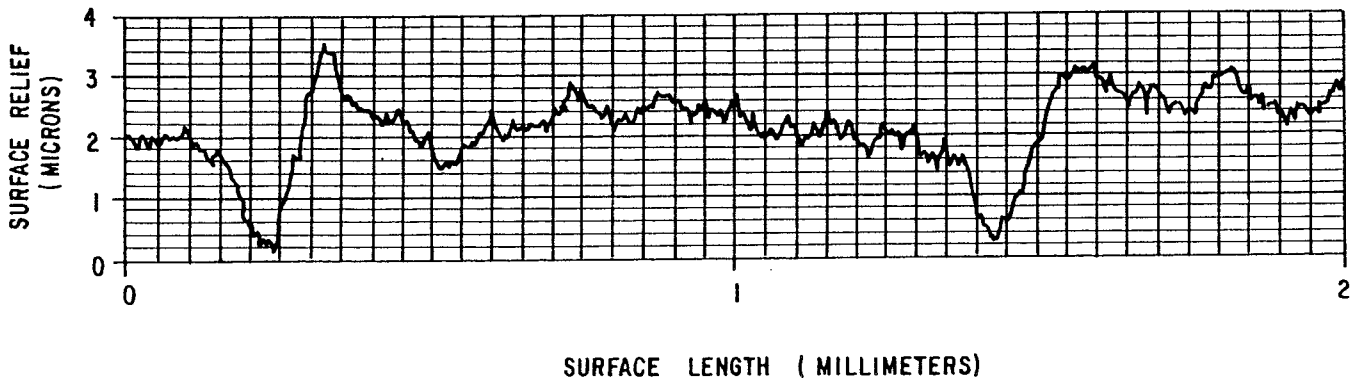
FIG. 3 (PRIOR ART)
FIG. 3 shows the profile of a copper surface similar to that of FIG. 1, after it has been subjected to a polishing process according to that described in the document SU-A-1,211,338.

FIGS. 1, 2 and 3 how the profile of the surface of the plate, respectively:

before polishing after the polishing of Example 1, after the polishing of Example 2.

In these figures, the length of the surface in mm is plotted on the abscissa axis, and the surface relief in microns is plotted on the ordinate axis.

Comparison of FIGS. 2 and 3 immediately brings out the progress made by the invention in the quality of the polishing.

We claim:

1. A bath for chemical polishing of a copper or copper alloy surface, comprising an aqueous solution of from about 1 to 6 moles/l of hydrogen peroxide, from about $10^4$ to 1 mole/l of chloride ions, from about $10^4$ to 1 mole/l of a mixture of phosphoric acid, phosphate ions, and hydrogen-phosphate ions, the molar quantity of phosphoric acid in said mixture, the molar quantity of phosphate ions in said mixture, and the molar quantity of hydrogenphosphate ions in said mixture being adjusted to impart a pH value of between 1.25 and 3 to the aqueous solution and to satisfy the following conditions $$0.01 \leqq \frac{\sum_{x=0}^{x=2} [(H_xPO_4)^{(3-x)-}]}{\sum_{x=0}^{x=3} [(H_xPO_4)^{(3-x)-}]} \leqq 1$$

where $[(H_xPO_4)^{3-x)-}]$ denotes the quantity, expressed in mole/l of the aqueous solution, of $(H_xPO_4)^{(3-x)-}$ ion in the aqueous solution.

2. A bath according to claim 1, wherein the aqueous solution has a pH value of between 1.65 and 2.35 and comprises:

hydrogen peroxide in a quantity of between 3 and 5 moles/l;

chloride ions in a quantity of between $5 \times 10^{-3}$ and $5 \times 10^{-2}$ mole/l;

phosphoric acid and phosphate and hydrogenphosphate ions in respective molar quantities in accordance with the following relationships:

$$0{,}05 \leqq \sum_{x=0}^{x=3} [(H_xPO_4)^{(3-x)-}] \leqq 0{,}4 \text{ mole/l}$$

and $$0{,}1 \leqq \frac{\sum_{x=0}^{x=2} [(H_xPO_4)^{(3-x)-}]}{\sum_{x=0}^{x=3} [(H_xPO_4)^{(3-x)-}]} \leqq 1$$

3. A bath according to claim 1, wherein the chloride ions are introduced into the aqueous solution in the form of alkali metal chloride and the phosphate and hydrogenphosphate ions are introduced in the form of alkali metal salts of phosphoric acid.

4. A process for polishing a copper or copper alloy surface, according to which the surface is brought into contact with a chemical polishing bath comprising an aqueous solution of from about 1 to 6 moles/l of hydrogen peroxide, from about $10^{-4}$ to 1 mole/l of chloride ions, from $10^{-4}$ to 1 mole/l of a mixture of phosphoric acid, phosphate ions and hydrogenphophate ions, the molar quantity of phosphoric acid in said mixture, the molar quantity of phosphate ions in said mixture, and the molar quantity of hydrogenphosphate ions in said mixture being adjusted so as to impart a pH value of between 1.25 and 3 to the aqueous solution and so as the following conditions apply $$0.01 \leqq \frac{\sum_{x=0}^{x=2} [(H_xPO_4)^{(3-x)-}]}{\sum_{x=0}^{x=3} [(H_xPO_4)^{(3-x)-}]} \leqq 1$$

where $[(H_xPO_4)^{(3-x)-}]$ denotes the quantity, expressed in mole/l of the aqueous solution, of $(H_xPO_4)^{(3-x)-}]$ ion in the aqueous solution.

5. Process according to claim 4, wherein the surface is maintained in contact with the bath for a time sufficient to achieve an attack of the metal over a depth equal to at least 10 microns.

6. Process according to claim 5, wherein the surface is maintained in contact with the bath for a time sufficient to achieve an attack of the metal over a depth of between 20 and 50 microns.

7. Process according to claim 5, wherein the temperature of the bath is adjusted to between 30° and 60° C., and it is maintained in contact with the surface for a length of time between 1 and 5 hours.

* * * * *